US005264043A

United States Patent [19]

Milocco

[11] Patent Number: 5,264,043

[45] Date of Patent: Nov. 23, 1993

[54] METHOD OF CONTROLLING A WASHING CYCLE IN AN AUTOMATIC DISHWASHER

[75] Inventor: Claudio Milocco, Pordenone, Italy

[73] Assignee: Zanussi Elettrodomestici S.p.A., Pordenone, Italy

[21] Appl. No.: 772,667

[22] Filed: Oct. 7, 1991

[30] Foreign Application Priority Data

Oct. 30, 1990 [IT] Italy ..... 45764 A/90

[51] Int. Cl.[5] ..... B08B 3/02

[52] U.S. Cl. ..... 134/25.2; 134/26; 134/36; 134/25.3; 134/95.3; 134/108

[58] Field of Search ..... 134/25.2, 25.3, 10, 134/26, 36, 95.3, 99.1, 103.3, 105, 108

[56] References Cited

U.S. PATENT DOCUMENTS 4,094,702 6/1978 Rabuffetti ..... 134/10
4,331,484 5/1982 Helwig, Jr. ..... 134/25.2
5,017,852 5/1991 Nagata et al. ..... 134/25.2

*Primary Examiner*—Theodore Morris
*Assistant Examiner*—Saeed T. Chaudhry
*Attorney, Agent, or Firm*—Wenderoth, Lind & Ponack

[57] ABSTRACT

The present invention relates to a method of controlling an automatic dishwasher having a tub, a lower spray arm and an upper spray arm disposed in the tub, a water circulating system including a pump for selectively supplying the spray arms with water, and a heater having a heating element in the tub. The method establishes at least an operative cycle in which the spray arms are supplied alternately with water to spray the crockery. The operative cycle includes a first phase (t1-t2) in which only the lower spray arm is supplied with water, and a second phase (t3-t4) in which only the upper spray arm is supplied with water. The heating element is only energized when the lower spray arm is being supplied with water.

5 Claims, 1 Drawing Sheet

METHOD OF CONTROLLING A WASHING CYCLE IN AN AUTOMATIC DISHWASHER

BACKGROUND OF THE INVENTION

1. Field of the Invention

The present invention relates to an improved washing and/or rinsing process in an automatic dishwashing machine of the type comprising a wash tub in which at least lower and upper baskets are provided for supporting crockery to be washed.

2. Description of the Related Art

Conventional dishwashers are known to have a plurality of baskets each associated with a respective rotary spray arm which is fed with water by a pump.

As described in EP-A-0 237 994, for instance, the spray arms are preferably supplied with water alternately, rather than concurrently. This allows the motor and the fluid circuit through which water is fed by the pump to be compact, and also reduces the noise produced by the water jets impinging on the crockery. To this aim, the spray arms are connected to the delivery section of the pump through respective supply conduits which are associated with a monostable flow distributing valve, the latter being indirectly controlled by the programmer of the machine to perform a washing cycle in which the spray arms are cyclically alternately operated. In particular, the flow distributing valve is controlled by repeatedly discontinuing, with different idle times, the energization of the motor driving the circulating pump.

Although this solution is particularly advantageous and precise in operation, the number of commutations occurring during every washing cycle may in the long run shorten the life of the motor.

In addition, when the resistive heating element of the water heater, that is positioned on the bottom of the wash tub, is energized during the operative phases in which only the upper spray arm is supplied with water, the element is easily overheated and therefore damaged, giving off bad odors. In fact, because the heating element is located relatively far from the upper spray arm, it is only insufficiently sprinkled by the water which is in suspension in the wash tub during such operative phases. This drawback, which for dimensional reasons does not arise when the lower spray arm is operated, may be overcome by increasing the amount of water fed into the tub. However, this compromises the current demand for energy saving devices.

As an alternative, the heater may be associated with special means capable of collecting the water circulated in the tub and keeping the resistive element wet with such water. This solution is only partially effective and in any case undesirably complicates the structure of the bottom part of the wash tub, therefore affecting the positioning of the various parts and increasing the manufacturing costs of the machine on an industrial scale.

Dishwashers are also known in which the resistive heating element is located at the delivery or suction side of the pump, so as to be permanently immersed in water when it is energized. This solution, however, involves remarkable complications in the structure and assembling of the machine. Furthermore, to prevent parts made of plastic which are adjacent to the resistive element from being damaged, it is necessary to provide temperature and/or level sensing devices capable of controlling the actual operating temperature of the heater and/or water level. The provision of such devices further complicates the structure of the whole dishwasher. Moreover, with such a solution it is obviously impossible to use the same heater to perform, as is traditional, a final drying phase of the crockery under "dry" conditions.

SUMMARY OF THE INVENTION

It is the main object of the present invention to provide a method of carrying out a washing cycle which achieves good performance in an automatic dishwasher of a substantially known type.

Another object of the present invention is to provide a method of the kind mentioned above, which enables the dishwasher to be generally compact, while maintaining a high degree of reliability.

A further object of the present method is to provide a washing method of the kind mentioned above, which substantially overcomes problems concerning the overheating of the water heating element without the need to provide the dishwasher with special structural features.

To achieve the above objects, the method according to the present invention includes a first step of circulating water only to the lower spray arm during a first phase of a washing cycle, subsequently circulating water only to the upper spray arm during a second phase of the washing cycle, and energizing the heating element only during the first phase of the washing cycle.

BRIEF DESCRIPTION OF THE DRAWINGS

The above objects and other characteristics and advantages of the invention will be more apparent from the following description, given only by way of non-limiting example, with reference to the accompanying drawings, in which.

DETAILED DESCRIPTION OF THE PREFERRED EMBODIMENT

Figure 1:
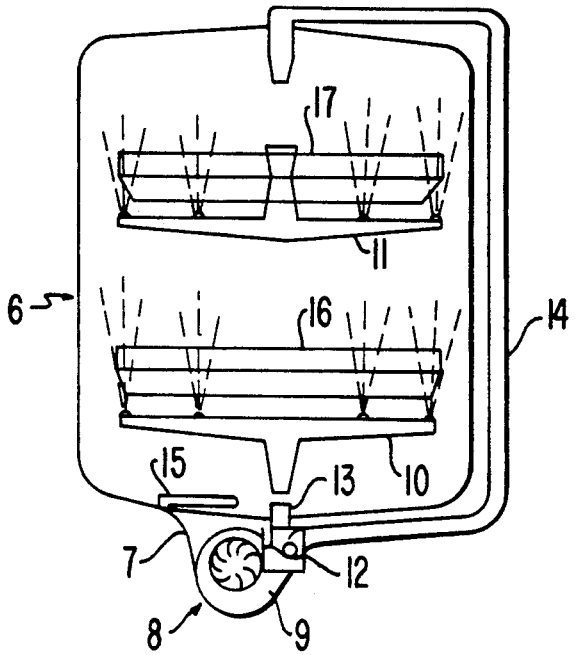
FIG. 1 is a schematic diagram of the main components of an automatic dishwasher to which the method according to the present invention is applicable.

With reference to FIG. 1, the method according to the invention is to be carried out in an automatic dishwasher of a per se known type, without the need to provide the dishwasher with substantial structural modifications. In particular, the dishwasher mainly comprises a wash tub 6 provided at the bottom with a sump 7 for collecting the water which is supplied to the machine in a known manner. The water can be heated by electric heating means having, for example, a common resistive heating element 15 located at the bottom of the tub. The suction side and the delivery side 9 of a water-circulating pump 8 are arranged to respectively draw water from the sump 7 and deliver it to at least two rotary spray arms 10 and 11. These spray arms are arranged in the tub 6 at different levels in association, respectively, with baskets 16 and 17 for supporting the articles to be washed.

More particularly, the delivery side of pump 8 is connected with the lower spray arm 10 via a conduit 13 extending upwards a short distance, and with the upper spray arm 11 via a conduit 14 extending upwards to a substantially higher level than the conduit 13.

The conduits 13 and 14 are in turn connected to the delivery side 9 of the pump 8 through a flow distributor 12 schematically shown in FIG. 1. In a per se known manner, the flow distributor 12 is able to be at least indirectly controlled by the programmer of the dishwasher in order to selectively communicate the delivery side 9 of pump 8 with either of the conduits 13 and 14.

The flow distributor 12 preferably, although not exclusively, takes the form disclosed in the aforementioned EP-A-0 237 994 document, to which reference is made for better comprehension thereof. In particular, the flow distributor 12 comprises a monostable ball valve through which the lower spray arm 10 or the upper spray arm 11 can be selectively supplied with water by temporarily stopping the operation of the pump 8 for a time period respectively shorter or longer than a predetermined interval.

The programmer of the automatic dishwasher, not shown, may be of any appropriate kind and in a per se known manner controls the operation of substantially all of the operative components of the machine; for instance, it may be an electronic programmer, readily programmable by a person skilled in the art.

In a way which is also per se known, the dishwasher may carry out an automatic washing process including the actual washing cycle, preceded by a prewashing cycle and preferably followed by at least a rinsing cycle.

Figure 2:
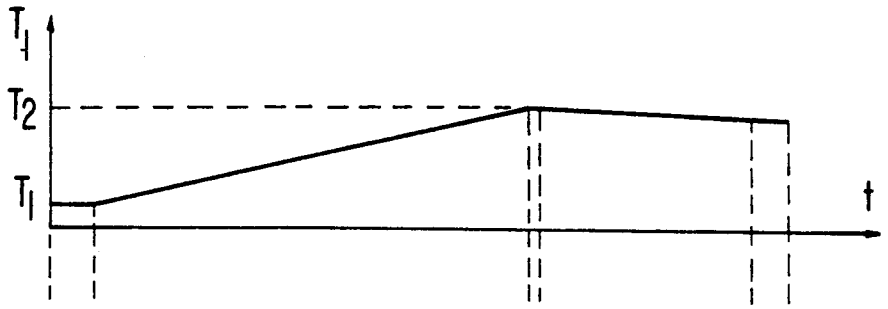
FIGS. 2 to 4 are curves respectively representing the time periods during which the components of the dishwasher are operated during the washing cycle according to the method of the present invention.
Figure 3:
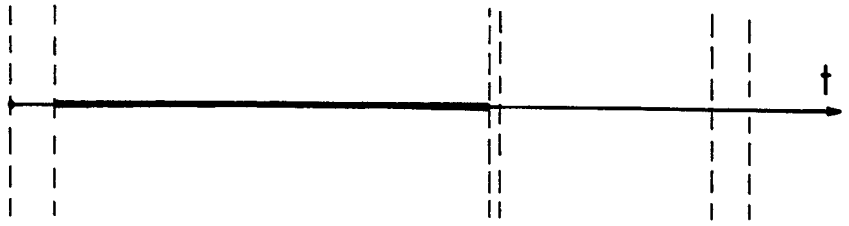
Figure 4:
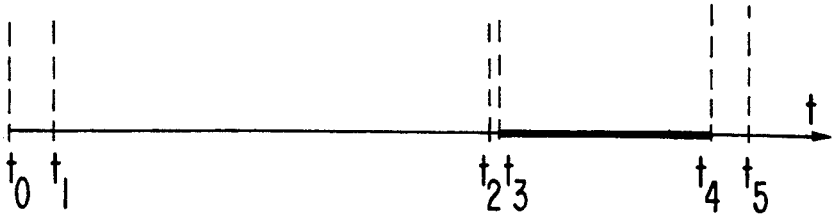

With reference also to FIGS. 2 to 4, a washing cycle is hereinafter described, which cycle is established by the method of controlling the dishwasher according to the invention. In particular, FIG. 2 diagramatically shows the changes versus time of the temperature T of the working fluid of the dishwasher, while FIGS. 3 and 4 diagrammatically illustrate the operational time periods under which the lower spray arm 10 and the upper spray arm 11 are operated, respectively.

At time to the programmer determines that the wash tub 6 is to be supplied with a predetermined amount of detergent and water at a temperature T1, of for instance, 20° C. (FIG. 2). After the termination of the water-filling phase, e.g. lasting about 1 to 3 min., the water-circulating pump 8 is actuated at time t1 with the flow distributor 12 arranged to connect the delivery side 9 of the pump to conduit 13. As shown in FIG. 3, only the lower spray arm 10 is supplied with water at time t1. According to an aspect of the invention, this condition is maintained for a substantial amount of time, e.g. a period of about 20 min. until time t2, at which time t2 the articles supported by the lower basket 16 are suitably cleaned.

The programmer controls the heater to energize the resistive heating element 15, in order to heat the water collected in the sump 7, only during a first predetermined period of time t1–t2 corresponding to a first phase of the washing cycle in which the lower spray arm 10 is in operation. Therefore, the temperature of the water rises gradually as shown in FIG. 2, up to a predetermined value T2, e.g. approximately 65° C., which may be thermostatically controlled in a per se known way.

Preferably, both the lower spray arm 10 and the heating element 15 are operated continuously and concurrently during phase t1–t2. As an alternative, however, the spray arm 10 and the heating element 15 may be operated intermittently under equal and/or different intervals during phase t1–t2. At any rate, attention is directed to the fact that during this phase the upper spray arm 11 is inoperative and the heating element is energized only when the lower spray arm 10 is supplied with water.

Hence, during phase t1–t2 the water circulation means, i.e. the pump 8 and flow distributor 12, is controlled to supply water only to the lower spray arm 10, which is substantially adjacent to the water collecting sump 7. As a consequence, the water sprayed by the spray arm 10 onto the basket 16 falls back into the sump 7 quickly, in this way ensuring that the heating element 15 is properly wetted continuously while it is energized, and even though the water level in the sump 7 decreases substantially while the pump 8 is in operation. This not only ensures a high degree of reliability for the resistive heating element 15 and the components adjacent thereto, but also enables the heat generated by the resistive heating element to be used in the best way. In other words, the resistive heating element 15 can effectively heat the water collected in the sump 7 rapidly, correspondingly shortening the time required for washing the crockery. Of course, the bad odors given off when the resistive heating element 15 is overheated are eliminated, and the resistive heating element 15 may have a simple and low-cost structure.

In addition, it was also experimentally determined that during the phase t1–t2, in which only the lower spray arm 10 is supplied with water, the hot moisture developed within the wash tub 6 affects the crockery supported by the upper basket 17, too. This moisture, constituted by water and detergent, produces on the crockery supported by the upper basket an emollient effect which advantageously promotes the detachment of dirt particles from the crockery, whose washing can thus be easily and rapidly completed.

At time t3, the programmer of the machine controls the flow distributor 12 to switch to the position in which it places the delivery side 9 of the pump 8 in communication with only the upper spray arm 11. When, as is preferable, the flow distributor 12 is a monostable valve as described in the aforementioned EP-A-0 237 994 document, this switching action can easily be effected by temporarily stopping the pump 8 for a time period longer than a predetermined interval, for instance 2 sec. Thus, time t3 can in this case occur at least two seconds after time t2, that is to say, with a delay which is negligible compared with the entire duration of the washing cycle.

From time t3, the upper spray arm 11 is supplied with water over a relatively short predetermined period (10 to 15 min. for example). This period of time t3–t4 corresponds to a phase which is shorter than the preceding phase t1–t2.

During this phase t3-t4 the heating element 15 is de-energized, and the lower spray arm 10 is inoperative. That is, the water circulation means is controlled so that the water is supplied only to the upper spray arm 11 which, thanks to the emollient effect referred to above and to the fact that the water temperature has been kept at a substantially constant value T2 (FIG. 2), effectively cleans the crockery supported by basket 17. During phase t3–t4, in fact, even though the heating element 15 is de-energized, the previously heated water contained in the tub 6 cools down to a negligible extent, thanks not only to the good thermal insulation provided in modern dishwashers, but also to the short duration of the second phase itself.

The upper spray arm 11 is preferably actuated continuously during phase t3–t4, but of course it could even be operated intermittently.

In any case, it should be pointed out that during both phases t1–t2 and t3–t4 the dishwasher needs a minimal amount of water to ensure correct priming of the pump 8 and to produce an effective cleaning action on the crockery by the water jets issuing from the spray arms 10 and 11, respectively.

The washing process terminates in a traditional manner, with a drain cycle effected in a phase t4-t5 during which the temperature of the water keeps decreasing as illustrated in FIG. 2.

As already stated, the washing process may also include a hot prewashing cycle and/or a hot rinsing cycle, respectively preceding and following the above-described washing cycle. The dishwasher is controlled in each such cycle in a manner substantially similar to the one described with reference to FIGS. 2 to 4. The only differences consist of the fact that the water temperature at the beginning of the washing cycle and/or at the beginning of the rinsing cycle will be higher if the water, the wash tub and the relevant components associated therewith have been formerly heated. Moreover, detergent will be added to the water in a known way during the prewashing and washing cycles, whereas rinse-aid will be added to the water during the rinsing cycle.

At any rate, the method of controlling the dishwasher according to the invention establishes at least an operative washing process substantially including a known water-filling cycle t0–t1, a washing cycle t1–t4 substantially consisting of a first phase t1–t2 in which the water is heated and only the lower spray arm is supplied with water and a second phase t3–t4 during which the heating element 15 is deenergized and only the upper spray arm 11 is supplied with water, and a known final draining cycle t4–t5. As already stated, the interval t2–t3 is negligible and may even be skipped if a flow distributor 12 other than the one described above, for example an electro-mechanical distributor, is employed.

Besides the advantages mentioned above, the method according to the invention enables the crockery to be properly cleaned with a relatively low water consumption and without the need to repeatedly switch the main operative components of the machine (i.e. circulating pump 8 and heating element 15) on and off, these components thus being reliable in the long run.

In addition, the duration of the washing process necessary to yield the same performance as the conventional washing process in which the spray arms are cyclically alternately operated, is comparatively short and is substantially equal in length to a conventional washing process in which the spray arms are operated concurrently (relevant drawbacks being overcome by the invention).

Obviously, the method of controlling the dishwasher to effect the washing process described above may undergo a number of modifications without departing from the scope of the invention.

For example, the control of the dishwasher may be carried out to establish a traditional final drying cycle, including a short phase in which the heating element 15 is energized under "dry" conditions.

Moreover, in order to clean the mechanical filter usually provided in the dishwasher, a further and negligible short phase (e.g. lasting about 15 sec) in which the lower spray arm 10 is operated may be provided after at least one of the operative cycles, including the washing cycle.

Anyway, it will be apparent to those skilled in the art that the method of controlling a known automatic dishwasher according to the present invention eliminates the need of special structural features; in fact, it will only be necessary to set the programmer of the machine to control the components to carry out the various operative phases under the conditions and times provided for by the invention.

What is claimed is:

1. A method of controlling a dishwasher having a wash tub, a lower spray arm disposed in a lower portion of the tub, an upper spray arm disposed above the lower spray arm in the tub, a heater having an energizable heating element disposed at the bottom of the tub below the lower spray arm, and water circulation means for selectively circulating water heated by the heating element at the bottom of the tub to the upper and lower spray arms, said method comprising:

controlling the water circulation means to circulate water only to the lower spray arm during a predetermined period of time corresponding to a first phase of a washing cycle;

subsequently controlling the water circulation means to circulate water only to the upper spray arm during a second period of time corresponding to a second phase of the washing cycle; and during said washing cycle, controlling the heater to energize the heating element only during said first phase when the lower spray arm is supplied with water by the water circulation means.

2. A method of controlling a dishwasher as claimed in claim 1, wherein said second predetermined period of time during which the second phase of the washing cycle is conducted is shorter than said first predetermined period of time.

3. A method of controlling a dishwasher as claimed in claim 1, wherein the controlling of the heater comprises energizing the heating element intermittently during the first phase of the washing cycle.

4. A method of controlling a dishwasher as claimed in claim 1, wherein the controlling of the water circulation means during the first phase of the washing cycle comprises controlling the water circulation means to intermittently supply water to the lower spray arm.

5. A method of controlling a dishwasher as claimed in claim 1, wherein the controlling of the water circulation means during the second phase of the washing cycle comprises controlling the water circulation means to intermittently supply water to the upper spray arm.

* * * * *